US011505449B2

(12) United States Patent
Fischer

(10) Patent No.: US 11,505,449 B2
(45) Date of Patent: Nov. 22, 2022

(54) METHOD FOR MANUFACTURING AN INNERSPRING UNIT

(71) Applicant: Spühl GmbH, Wittenbach (CH)

(72) Inventor: Andreas Fischer, Schwarzenbach (CH)

(73) Assignee: Spühl GmbH, Wittenbach (CH)

( * ) Notice: Subject to any disclaimer, the term of this patent is extended or adjusted under 35 U.S.C. 154(b) by 0 days.

(21) Appl. No.: 17/521,060

(22) Filed: Nov. 8, 2021

(65) Prior Publication Data

US 2022/0055890 A1 Feb. 24, 2022

Related U.S. Application Data

(62) Division of application No. 16/619,998, filed as application No. PCT/EP2017/063799 on Jun. 7, 2017, now Pat. No. 11,267,691.

(51) Int. Cl.
*B68G 9/00* (2006.01)
*B68G 7/00* (2006.01)
(Continued)

(52) U.S. Cl.
CPC ..... *B68G 9/00* (2013.01); *A47C 27/062* (2013.01); *A47C 27/064* (2013.01); *A47C 27/07* (2013.01);
(Continued)

(58) Field of Classification Search
CPC ... B68G 7/00; B68G 7/05; B68G 7/12; B68G 9/00; B68G 15/005; A47C 27/062; A47C 27/064; A47C 27/07
(Continued)

(56) References Cited

U.S. PATENT DOCUMENTS 4,389,743 A 6/1983 Callaway
4,566,926 A 1/1986 Stumpf
(Continued)

FOREIGN PATENT DOCUMENTS

DE 19621361 A1 12/1997
EP 2295373 A1 3/2011
(Continued)

OTHER PUBLICATIONS

Saba Adhesives & Sealants; "Saba Hotmelt Adhesive—Manual Application(EN)"; Youtube dated Jul. 3, 2013, 1 Page, Retrived from the Internet: URL:https://www.youtube.com/watch?v=dclrrhd0P18 [retrived on Feb. 13, 2020].

*Primary Examiner* — Stephen F. Gerrity
(74) *Attorney, Agent, or Firm* — Wood Herron & Evans LLP

(57) ABSTRACT

In order to manufacture an innerspring unit comprising pocketed springs and having an increased stability at its edge regions, in a first step, an innerspring main body comprising a plurality of first strings of pocketed springs is provided. In a subsequent second step, at least one second string of pocketed springs is attached to a lateral surface of the innerspring main body, so that the at least one second string of pocketed springs extends in a longitudinal direction of the innerspring main body. The springs of the at least one second string of pocketed springs have a spring characteristic or a spring geometry different from the springs of the plurality of first strings of the innerspring main body. The at least one second string of pocketed springs forms together with the innerspring main body the innerspring unit.

20 Claims, 5 Drawing Sheets

(51) Int. Cl.

| | |
|---|---|
| ***A47C 27/06*** | (2006.01) |
| ***A47C 27/07*** | (2006.01) |
| ***B68G 7/05*** | (2006.01) |
| ***B68G 7/12*** | (2006.01) |
| ***B68G 15/00*** | (2006.01) |

(52) U.S. Cl.
CPC ..... *B68G 7/00* (2013.01); *B68G 7/05* (2013.01); *B68G 7/12* (2013.01); *B68G 15/005* (2013.01); *B68G 2009/005* (2013.01)

(58) Field of Classification Search
USPC ..... 53/114; 29/91
See application file for complete search history.

(56) References Cited

U.S. PATENT DOCUMENTS

| | | | | |
|---|---|---|---|---|
| 4,995,162 | A | 2/1991 | Betere Cabeza | |
| 5,054,178 | A | 10/1991 | Zuger | |
| 6,159,319 | A | 12/2000 | Mossbeck | |
| 6,256,820 | B1 | 7/2001 | Moser et al. | |
| 6,295,676 | B1 | 10/2001 | Warner | |
| 6,684,435 | B1 | 2/2004 | Wells | |
| 11,267,691 | B2 * | 3/2022 | Fischer | B68G 9/00 |
| 2002/0124321 | A1 | 9/2002 | Wells | |
| 2011/0107572 | A1 | 5/2011 | Kim | |
| 2012/0102658 | A1 | 5/2012 | Mantzis et al. | |
| 2013/0232699 | A1 | 9/2013 | Hinshaw | |
| 2014/0061985 | A1 | 3/2014 | Whitworth et al. | |
| 2014/0166207 | A1 | 6/2014 | Hug et al. | |
| 2014/0201924 | A1 | 7/2014 | Wolfson | |
| 2016/0166076 | A1 | 6/2016 | Mossbeck | |
| 2016/0214219 | A1 | 7/2016 | Subhedar et al. | |
| 2016/0214804 | A1 | 7/2016 | Subhedar et al. | |
| 2016/0227938 | A1 | 8/2016 | Pennington et al. | |
| 2017/0340130 | A1 | 11/2017 | Mossbeck | |
| 2018/0049559 | A1 | 2/2018 | Jewett et al. | |
| 2020/0307990 | A1 | 10/2020 | Spinks et al. | |

FOREIGN PATENT DOCUMENTS

| | | | | | |
|---|---|---|---|---|---|
| GB | 2416690 | A | * | 2/2006 | B68G 9/00 |
| JP | H09276084 | A | | 10/1997 | |
| WO | 2015/114361 | A1 | | 8/2015 | |
| WO | 2016118865 | A1 | | 7/2016 | |
| WO | 2016/174446 | A1 | | 11/2016 | |

* cited by examiner

METHOD FOR MANUFACTURING AN INNERSPRING UNIT

CROSS-REFERENCE TO RELATED APPLICATIONS

This application is a Divisional of U.S. patent application Ser. No. 16/619,998, filed Dec. 6, 2019 (pending), which claims priority to International Patent Application No. PCT/EP2017/063799, filed Jun. 7, 2017 (expired), the disclosures of which are incorporated by reference herein.

TECHNICAL BACKGROUND OF THE INVENTION

The present invention relates to a method and an apparatus for manufacturing an innerspring unit comprising a plurality of pocketed or encased springs as well as a corresponding innerspring unit.

Innerspring units are typically used in innerspring mattresses. Conventional innerspring configurations include innerspring units in which coil springs are encased in welded pockets of a fabric material. Individual strings of such pocketed springs are connected to one another so as to form an array of a plurality of pocketed springs arranged in rows and columns.

Such innerspring units may be manufactured by innerspring unit assembly machines which make innerspring units from endless strings of pocketed springs. Conventional innerspring unit assembly machines produce innerspring units in which all of the springs have the same or very similar spring characteristics, e.g., spring diameter, wire diameter or spring material, resulting in a uniform spring stability across the entire innerspring unit, or in which the strings of pocketed springs only extend in one direction of the corresponding innerspring unit.

It is an object of the present invention to provide a manufacturing method and a manufacturing apparatus, which allow to manufacture innerspring units with an increased flexibility. In particular, it is an object of the present invention to provide a manufacturing method and a manufacturing apparatus, which allow to manufacture innerspring units having an increased stability in an edge area of the innerspring units. Moreover, it is an object of the present invention to provide such a manufacturing method and such a manufacturing apparatus, which allow to manufacture innerspring units having different pocketed springs with a different diameter in an edge area of the innerspring units. Finally, it is an object of the invention to provide such a manufacturing method and such a manufacturing apparatus which allow to manufacture innerspring units in an innerspring unit assembly machine using a fully automated process.

BRIEF SUMMARY OF THE INVENTION

According to an embodiment of the invention, in a first step, an innerspring main body or a spring core is manufactured from a plurality of first strings of pocketed springs. The plurality of first strings may extend in a width direction of the innerspring main body. In a second step, at least one second string of pocketed springs is attached to a lateral surface of the innerspring main body, the at least one second string of pocketed springs extending in a longitudinal direction of the innerspring main body and including springs having a spring characteristic and/or spring geometry different from the springs of the plurality of first strings of pocketed springs of the innerspring main body.

In a further embodiment of the invention, the innerspring main body may already be equipped at its longitudinal front and rear ends with further strings of pocketed springs which also have a spring characteristic and/or spring geometry different from the springs of the plurality of first strings of pocketed springs of the innerspring main body and which may also extend in the width direction of the innerspring main body, so that after the attachment of the second strings of pocketed springs to both lateral surfaces of the innerspring main body, an edge area or a border area surrounding the first strings of pocketed springs is formed.

The edge springs thus added to the innerspring main body may be configured such that they themselves have a larger stability and/or a different geometry, e.g. a different diameter, than the springs of the first strings of pocketed springs, so that by the attachment of the edge springs, the innerspring unit becomes more stable in the edge area. The increased stability of the edge springs may result from the geometry of the edge springs. In particular, the edge springs may have a smaller diameter than the inner springs of the innerspring unit. If the edge springs are of a smaller diameter, lateral recesses formed in the innerspring unit between adjacent strings of pocketed springs also become smaller, resulting in a more even lateral surface of the innerspring unit and allowing to arrange more springs per innerspring unit, thereby increasing the stability in the edge area of the innerspring unit.

The innerspring unit of the invention may be produced in a single system, i.e., in a single innerspring unit assembly machine, using a fully automated manufacturing process. Since the innerspring unit or core always remains in the process, the dimensional accuracy of the innerspring unit can be ensured. This allows that the size of the strings of the pocketed edge springs can be appropriately chosen, and the strings of the pocketed edge springs can be easily attached to the innerspring main body, thereby reducing the personnel expenses and the manufacturing cost. In addition, the quality of the innerspring units can be improved compared to hand-made innerspring units.

According to an embodiment of the invention, the method for manufacturing an innerspring unit comprising pocketed springs comprises the steps (a) providing an innerspring main body comprising a plurality of first strings of pocketed springs, and (b) attaching at least one second string of pocketed springs to a lateral surface of the innerspring main body, so that the at least one second string of pocketed springs extends in a longitudinal direction of the innerspring main body, wherein the springs of the at least one second string of pocketed springs have a spring characteristic different from the springs of the plurality of first strings of the innerspring main body, the at least one second string of pocketed springs forming together with the innerspring main body the innerspring unit.

Step (a) may comprise providing the innerspring main body with at least one third string of pocketed springs at a first longitudinal end of the innerspring main body and with at least one fourth string of pocketed springs at a second longitudinal end of the innerspring main body, wherein the springs of the at least one third string of pocketed springs and the springs of the at least one fourth string of pocketed springs have a spring characteristic different from the springs of the plurality of first strings of the innerspring main body. The springs of the second, third and fourth strings of pocketed springs may have a spring stability and/or spring geometry different from that of the springs of the first strings of pocketed springs. In particular, the diameter of the springs of the second, third and fourth strings of pocketed springs may be different from, preferably smaller than, that of the springs of the first strings of pocketed springs.

Step (b) may comprise attaching at least one second string of pocketed springs to a first lateral side surface and to a second lateral side surface of the innerspring main body, so that the springs of the second, third and fourth strings of pocketed springs form an edge area completely surrounding the first strings of pocketed springs.

According to a further embodiment, step (a) may comprise attaching a pair of fleece sheets or scrim sheets to upper and lower surfaces of the innerspring main body, so that the fleece sheets cover the innerspring main body and laterally extend beyond the innerspring main body; and step (b) may comprise attaching the at least one second string of pocketed springs to the lateral surface of the innerspring main body such that it is arranged between the pair of fleece sheets.

The use of such fleece sheets at the upper and lower surfaces of the innerspring main body ensures that the innerspring main body remains stable in length and width after step (a).

The fleece sheets may be clamped by a clamping device, so that the at least one second string of pocketed springs can be pushed with a pusher between the fleece sheets to the lateral side of the innerspring main body without moving or pushing the fleece sheets.

According to a further embodiment, step (b) comprises applying a glue to the lateral side of the innerspring main body by a gluing device prior to attaching the at least one second string of pocketed springs to the innerspring main body. The glue may also be applied to the top and bottom fleece sheets so as to ensure that the pocketed springs of the innerspring main body including the springs of the at least one second string are securely attached to the fleece sheets.

Step (b) may further comprise compressing the springs of the at least one second spring of pocketed springs prior to their attachment to the innerspring main body and allowing the compressed strings to expand after attaching the at least one second spring of pocketed springs to the lateral surface of the innerspring main body.

The invention may be performed as a fully automated process by an innerspring unit assembly machine comprising a first station for providing the innerspring main body by carrying out step (a) and a second station for manufacturing the innerspring unit from the innerspring main body and the at least one second string of pocketed springs by carrying out step (b). The innerspring main body may be transported from the first station to the second station using a conveyor device.

According to a further embodiment of the invention, the invention provides an apparatus for manufacturing an innerspring unit comprising pocketed springs, the apparatus comprising (a) a first station for manufacturing an innerspring main body from a plurality of first strings of pocketed springs, and (b) a second station for attaching at least one second string of pocketed springs to a lateral surface of the innerspring main body, so that the at least one second string of pocketed springs extends in a longitudinal direction of the innerspring main body, wherein the springs of the at least one second string of pocketed springs have a spring characteristic different from the springs of the plurality of first strings of the innerspring main body, the at least one second string of pocketed springs forming together with the innerspring main body the innerspring unit.

The apparatus may be configured to perform the method according to the aforesaid embodiments.

Finally, according to another embodiment of the invention, an innerspring unit is provided which comprises (a) an innerspring main body comprising a plurality of first strings of pocketed springs, and (b) at least one second string of pocketed springs attached to a lateral surface of the innerspring main body, so that the at least one second string of pocketed springs extends in a longitudinal direction of the innerspring main body, wherein the springs of the at least one second string of pocketed springs have a spring characteristic different from the springs of the plurality of first strings of the innerspring main body.

The innerspring unit may be manufactured by the method and the apparatus according to the aforesaid embodiments.

In the following, embodiments of the invention will be described in detail with reference to the accompanying drawings.

DETAILED DESCRIPTION OF THE DRAWINGS

FIGS. 1A-FIG. 1D show different views to illustrate the manufacturing of an innerspring unit according to an embodiment of the invention.

In a first step, at a first station of an innerspring unit assembly machine, an innerspring main body may be manufactured from a plurality of first strings of pocketed springs. The first station of the innerspring unit assembly machine receives an endless string of pocketed springs and cuts this endless string of pocketed springs into the plurality of first strings of pocketed springs having an equal length. The individual first strings of pocketed springs are then attached to one another to form the innerspring main body as an array of pocketed springs being arranged in rows and columns.

Figure 1A:
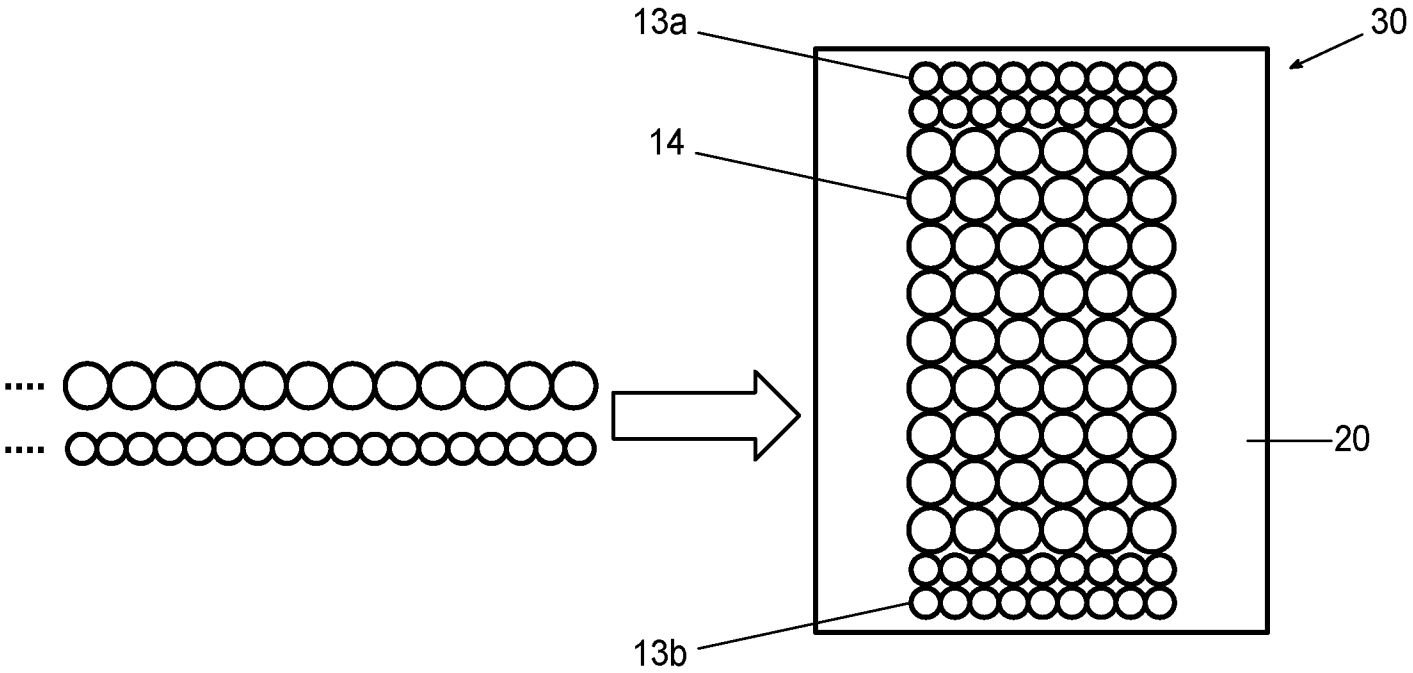
FIGS. 1A-1D show a method for manufacturing an innerspring unit comprising pocketed springs and a corresponding innerspring unit according to an embodiment of the invention.

In FIG. 1A, the first strings of pocketed springs, which form the core of the innerspring main body 30, are indicated by reference numeral 14. The individual strings 14 of pocketed springs may be attached to one another by gluing, for example. To ensure a sufficient stability of the innerspring main body 30 both in length and width direction, a fleece sheet 20 is attached and glued both to the upper surface and the lower surface of the innerspring main body 30. In FIG. 1A, only the lower fleece sheet 20 is shown. The dimension of the fleece sheets is such that they extend at least in the width direction beyond the innerspring main body 30, as shown in FIG. 1A.

In the embodiment of FIG. 1A, the innerspring main body 30 is manufactured with edge springs increasing the stability of the innerspring main body 30 at its longitudinal front and rear edges. To this end, one or more strings 13*a*, 13*b* of pocketed springs having a different spring characteristic or geometry than the springs of the first strings 14 are provided both at the front and rear ends of the innerspring main body 30. As indicated in FIG. 1A, for example, the springs of the strings 13*a*, 13*b* may have a smaller diameter than the springs of the strings 14, so that these edge springs increase the stability of the innerspring main body 30 at its longitudinal edges. Similar to the first strings 14 of pocketed springs, the strings 13*a*, 13*b* of pocketed springs are cut from a corresponding endless string of pocketed springs, and especially the length of the strings 13*a*, 13*b* is identical or at least similar to the length of the strings 14.

It should be noted that in case an increased stability at the longitudinal edges of the innerspring main body 30 is not desired or not necessary, the springs of the strings 13*a*, 13*b* may be omitted.

Figure 1B:
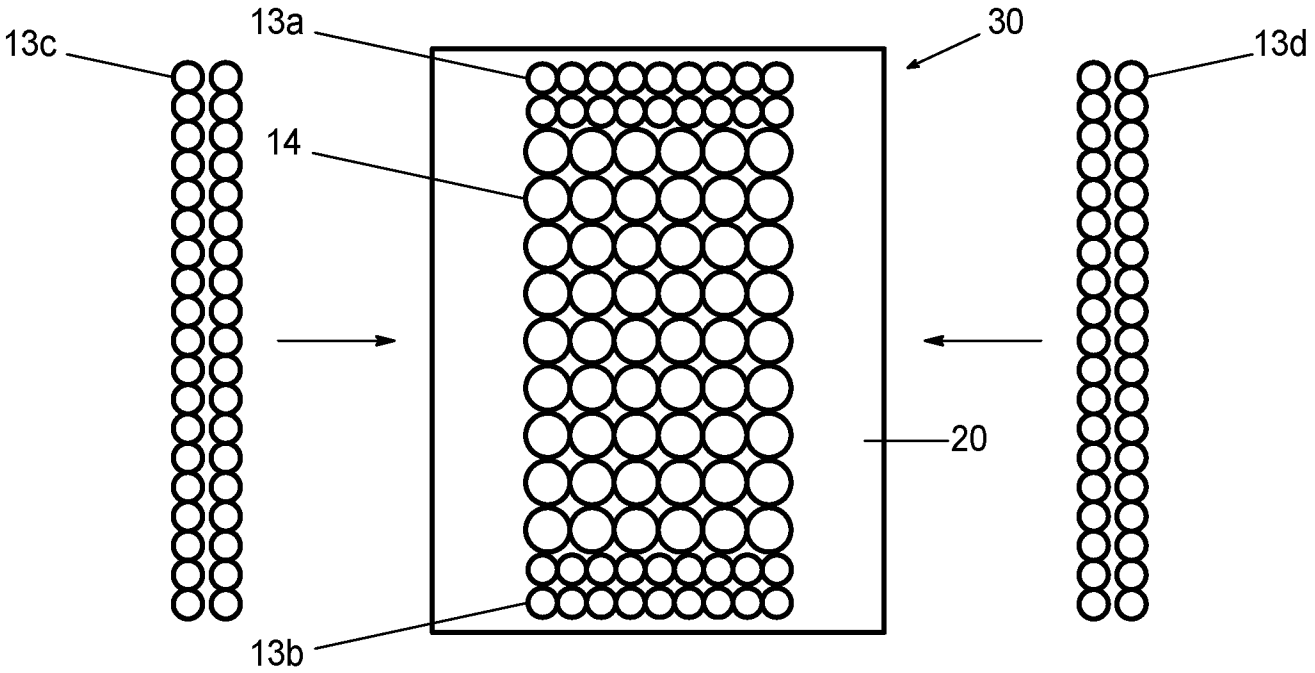

To increase the stability of the innerspring main body 30 along its lateral side edges as well, i.e., in the width direction, corresponding edge springs are attached in a further step shown in FIG. 1B.

The step shown in FIG. 1B is performed at a second station of the innerspring assembly machine and attaches one or more strings 13*c*, 13*d* of pocketed springs to both lateral surfaces of the innerspring main body 30, the springs of the one or more strings 13*c*, 13*d* of pocketed springs again have a spring characteristic different from the springs of the plurality of first strings 14 of the innerspring main body 30.

The one or more strings 13*c*, 13*d* of pocketed springs are arranged such that they extend in the longitudinal direction of the innerspring main body 30. Furthermore, the one or more strings 13*c*, 13*d* are arranged at the lateral surface or periphery of the innerspring main body 30 such that they are located between the fleece sheets 20, where they are then glued to the lateral surfaces of the innerspring main body 30.

Again, it should be noted that it is of course also possible to attach one or more strings 13*c*, 13*d* of pocketed springs to only one of the lateral surfaces of the innerspring main body 30 if it is sufficient or desired to provide only one of the later surfaces of the innerspring main body 30 with an increased stability along its longitudinal edge.

Figure 1D:
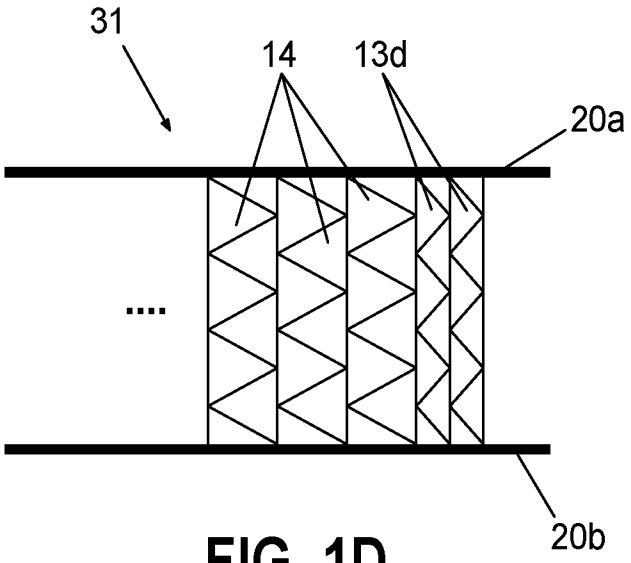
Figure 1C:
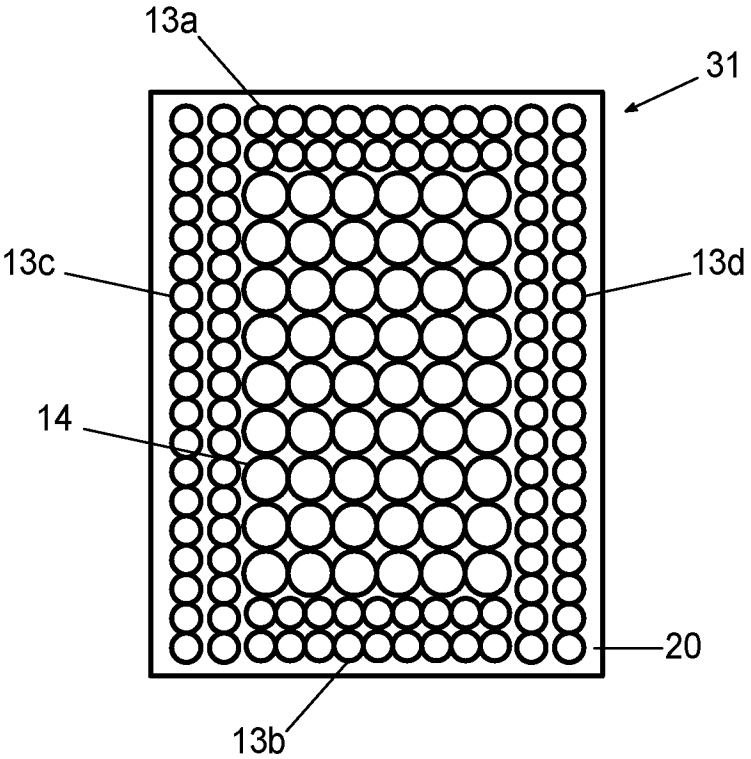

In the embodiment shown in FIGS. 1A-1D, however, the innerspring main body 30 is provided with the additional strings 13*a*-13*d* of pocketed springs such that they form a closed border area or edge area of springs having an increased stability compared to the springs of the strings 14, this border area completely surrounding the springs of the strings 14, as it is shown in FIG. 1C. Consequently, the length of the one or more lateral strings 13*c*, 13*d* of pocketed springs is such that it substantially corresponds to the longitudinal length of the innerspring main body 30, as indicated in FIG. 1B, so that—once the strings 13*c*, 13*d* have been attached to the innerspring main body 30—the desired closed edge area of the Springs having the increased stability is formed by the springs of the strings 13*a*-13*d*.

The final innerspring unit 31 comprising the innerspring main body 30 in combination with the laterally attached strings 13*c*, 13*d* of pocketed springs is shown in FIG. 1C.

FIG. 1D shows a cross-sectional view of the innerspring unit 31 through the right edge of the innerspring unit 31 shown in FIG. 1C. FIG. 1D shows that the pocketed springs of the strings 14 and the pocketed springs of the strings 13*d* are arranged between the two fleece sheets 20*a*, 20*b* extending along the top and the bottom of the innerspring unit 31.

Figure 2:
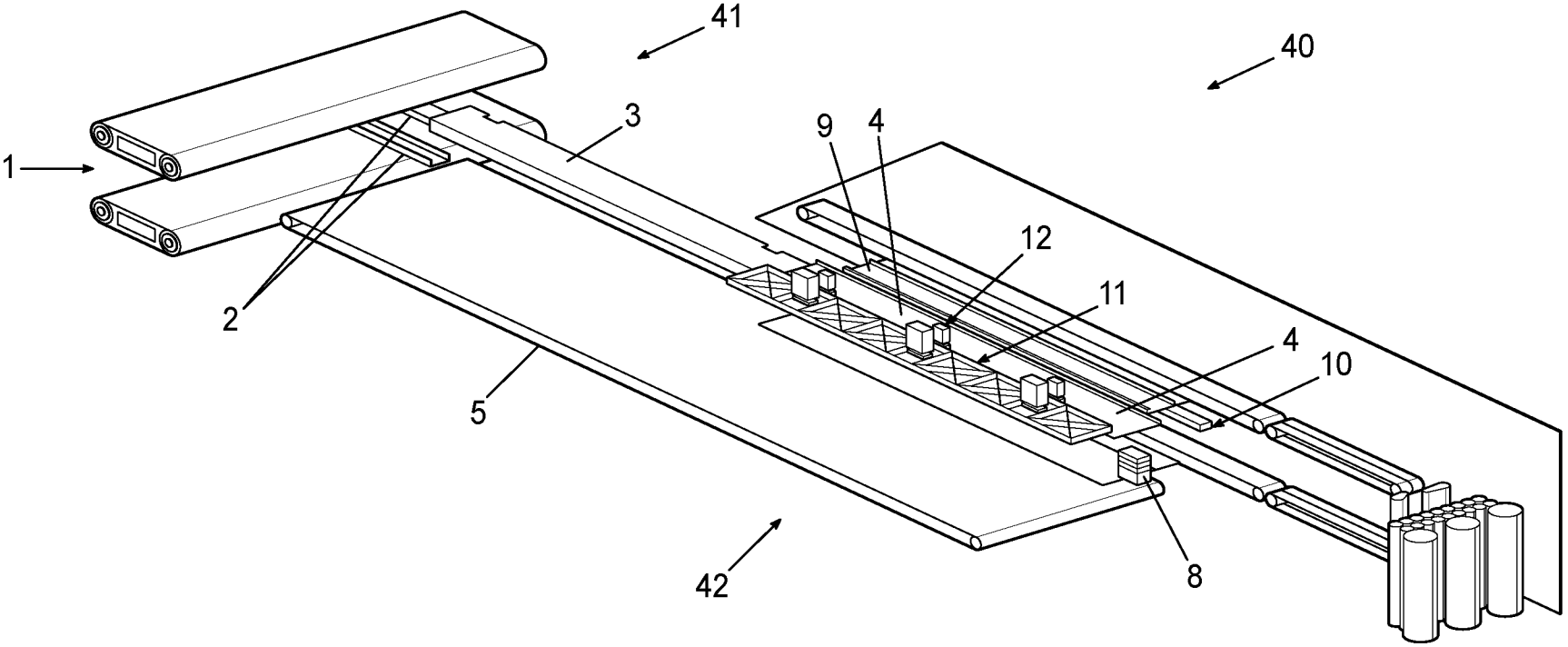
FIG. 2 shows an apparatus for manufacturing an innerspring unit comprising pocketed springs according to an embodiment of the invention.

FIG. 2 shows an apparatus for manufacturing an innerspring unit comprising pocketed springs according to an embodiment of the invention. FIG. 2 shows a cross-sectional view of the manufacturing apparatus.

The apparatus 40 shown in FIG. 2 is an innerspring unit assembly machine comprising substantially two stations 41 and 42. The first station 41 is provided for manufacturing the innerspring main body 30 shown in FIG. 1A, while the second station 42 is provided for manufacturing the innerspring unit 31 from the innerspring main body 30 of the first station 41 and the later strings 13*c*, 13*d* of pocketed springs, as shown in FIG. 1B.

The innerspring main body 30, including the inner strings 14 of pocketed springs as well as the fleece sheets 20*a*, 20*b* and the edge springs of the strings 13*a*, 13*b* having the increased stability at the longitudinal ends of the innerspring main body 30, is manufactured at the first station 41 which may have the structure of an innerspring unit assembly machine. This first station 41 comprises a compression unit 1 for the attachment of the fleece sheets 20*a*, 20*b* to the innerspring main body 30. In addition, the first station 41 comprises a fleece guide 2, which prevents the fabric from hanging down from the side of the springs of the innerspring main body 30 and ensures an appropriate guidance for the fleece. The product output by the first station 41 is the innerspring main body 30 as shown in FIG. 1A, for example.

The innerspring main body 30 is transported from the first station 41 to the second station 42 using a conveyor device 5. The conveyor device 5 comprises a guide 3 which, together with the fleece guide 2, serves as a lateral support, so that the innerspring main body 30 cannot move sideways during its transport from the first station 41 to the second station 42. The conveyor device 5, which may comprise one or more conveyor belts, supports the innerspring main body 30 and ensures that the fleece does not hang downward.

After the compression unit 1, the fleece sheets 20*a*, 20*b* are cut, so that the innerspring main body 30 is decoupled from the previous process performed by the first station 41 which now can continue to produce another innerspring main body. The innerspring main body 30 is transported by means of the conveyor device 5 to a mounting position specified by a sensor (not shown) where the lateral strings 13*c*, 13*d* of pocketed springs are attached to the innerspring main body 30 to form the final innerspring unit 30.

Once the innerspring main body 30 has arrived at the mounting position, a compression device 11 is activated. The compression device comprises compression plates which lightly compress the springs of the innerspring main body 30 in the lateral edge regions of the innerspring main body 30. In particular, the compression device compresses the springs 13 of the lateral strings 13*c*, 13*d* prior to their attachment to the innerspring main body 30.

Figure 3:
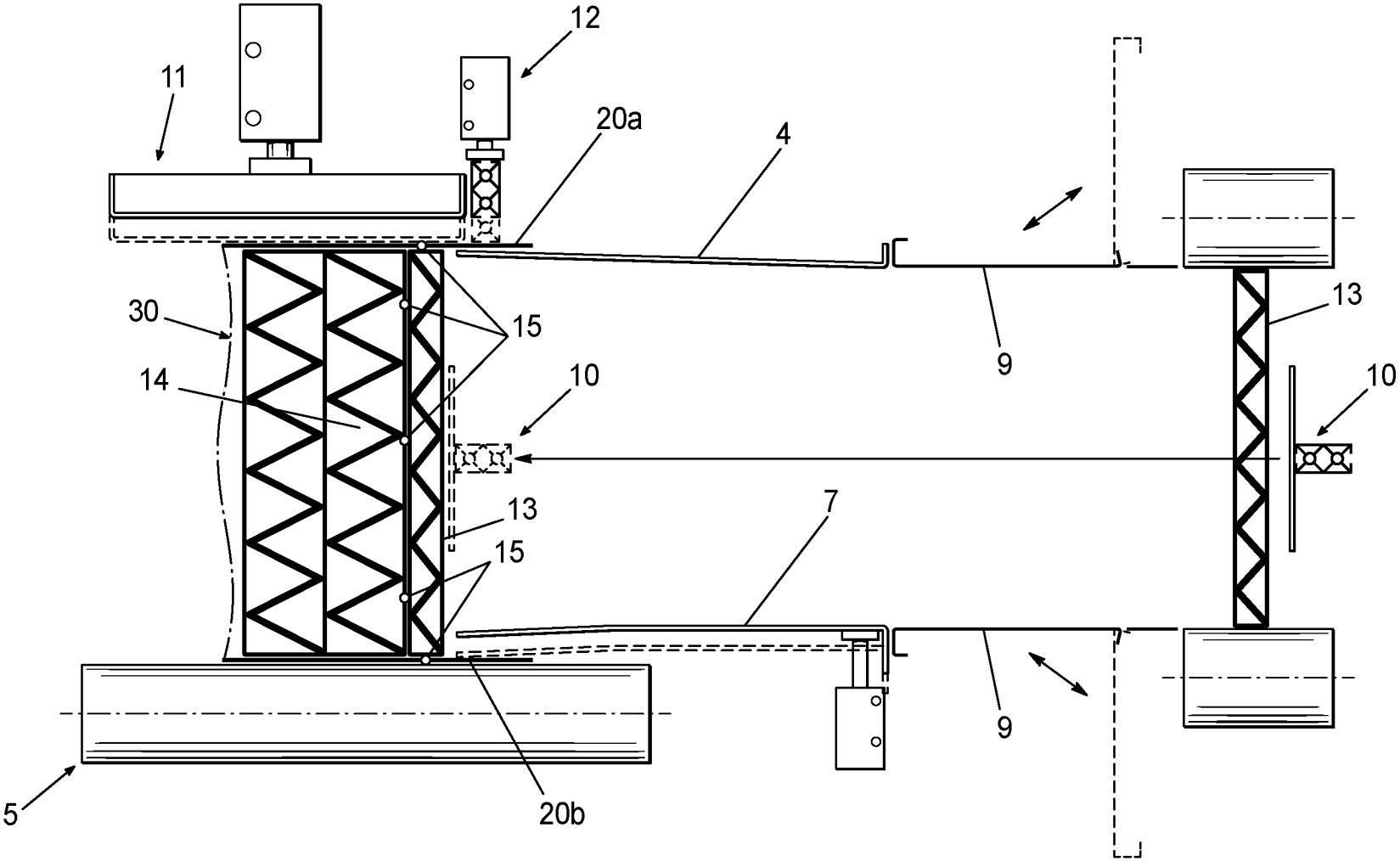
FIG. 3 shows a partial side view of the apparatus of FIG. 2 to illustrate the operating principle of the apparatus.

A gluing device 8 is operated to apply glue along the respective lateral surface of the innerspring main body 30, as indicated at 15 in FIG. 3. According to an embodiment of the invention, when the innerspring main body 30 has reached the mounting position of the second station 42, the gluing device 8 is moved along the respective lateral surface of the innerspring main body 30 in the longitudinal direction of the innerspring main body to spray glue onto the lateral surface of the innerspring main body 30. The gluing device 8 may also be operated to apply glue to the surfaces of the fleece sheets 20*a*, 20*b* facing the strings 13*c*, 13*d* of pocketed springs.

The pocketed springs of the lateral strings 13*c*, 13*d* are each prefabricated by a respective unit per side. These units include typical components of an innerspring unit assembly machine, including a spring feeder, a changer, spring inserter, and the gluing device etc.

The respective string 13*c*, 13*d* of pocketed springs is pushed toward the innerspring main body 30 between upper and lower guide plates 4, 7 using a pushing device 10 (see FIG. 3). When the gluing device 8 has been extracted from the working position, upper and lower flaps 9 are closed as shown in FIG. 3 and are brought from a vertical open position to the closed horizontal position to close the gap to allow the pushing of the strings 13*c*, 13*d* to the innerspring main body 31.

A fleece clamping device 12 is operated to clamp the fleece sheets, so that during the pushing of the strings 13*c*, 13*d* the fleece sheets are not also pushed by the pushing device 10. In particular, the fleece clamping device 12 clamps the upper fleece sheet 20*a*, while the lower fleece sheet 20*b* may be clamped by the lower guide plate 7.

Since the springs at the edge region of the innerspring main body 30 are compressed by the compression device 11, a sufficient contact pressure can be established between the springs 14 at the edge region of the innerspring main body 30 and the springs 13 of the strings 13*c*, 13*d* pushed against the innerspring main body by the pushing device 10 as well as between the springs 13 of the strings 13*c*, 13*d* and the fleece sheets 20*a*, 20*b*. As indicated in FIG. 3, the springs 13 compressed by the compression device 11 can expand again and, consequently, press upwards and downwards once they have been pushed beyond the guide plates 4,7 by the pushing device 10. This biasing of the springs 13 ensures that the glue is pressed against the top and bottom fleece sheets. The expansion of the springs 13 preferably happens close to the end of the entire process prior to the output of the innerspring unit by the assembly machine.

In case another string 13*c*, 13*d* of pocketed springs is to be attached to the lateral surfaces of the innerspring main body 30, the process described above is repeated, so that one string 13*c*, 13*d* of pocketed springs is attached to the innerspring main body 30 after the other. Alternatively, it may also be possible to pre-fabricate sets of a number of strings 13*c*, 13*d* (for example, such as those indicated in FIG. 1B), in which the individual strings are already glued to each other, and to attach these sets in one step to the lateral surfaces of the innerspring main body 30.

What is claimed is:

1. A method for manufacturing an innerspring unit comprising pocketed springs, the method comprising the steps of (a) providing an innerspring main body comprising a plurality of first strings of pocketed springs; and (b) attaching at least one second string of pocketed springs to a lateral surface of the innerspring main body, so that the at least one second string of pocketed springs extends in a longitudinal direction of the innerspring main body, wherein the springs of the at least one second string of pocketed springs have a spring characteristic or a spring geometry different from the springs of the plurality of first strings of the innerspring main body, the at least one second string of pocketed springs forming together with the innerspring main body the innerspring unit, wherein step (a) comprises attaching a pair of fleece sheets to upper and lower surfaces of the innerspring main body, so that the fleece sheets cover the innerspring main body and laterally extend beyond the innerspring main body; and wherein step (b) comprises attaching the at least one second string of pocketed springs to the lateral surface of the innerspring main body such that it is arranged between the pair of fleece sheets.

2. The method of claim 1, wherein step (a) comprises providing the innerspring main body with at least one third string of pocketed springs at a first longitudinal end of the innerspring main body and with at least one fourth string of pocketed springs at a second longitudinal end of the innerspring main body, wherein the springs of the at least one third string of pocketed springs and the springs of the at least one fourth string of pocketed springs have a spring characteristic or a spring geometry different from the springs of the plurality of first strings of the innerspring main body.

3. The method of claim 2, wherein step (b) comprises attaching at least one second string of pocketed springs to a first lateral side surface and to a second lateral side surface of the innerspring main body, so that the springs of the second, third and fourth strings of pocketed springs form an edge area completely surrounding the first strings of pocketed springs.

4. The method of claim 2, wherein the springs of the second, third and fourth strings of pocketed springs are configured such that a stability of the innerspring unit at an edge area thereof is increased compared to an area where the springs of the first strings of pocketed springs are arranged.

5. The method of claim 1, wherein step (b) comprises clamping the fleece sheets by a clamping device and pushing the at least one second string of pocketed springs with a pusher between the fleece sheets to the lateral side of the innerspring main body.

6. The method of claim 1, wherein step (b) comprises applying a glue to the pair of fleece sheets by a gluing device prior to attaching the at least one second spring of pocketed springs to the innerspring main body.

7. The method of claim 1, wherein step (b) comprises applying a glue to the lateral side of the innerspring main body by a gluing device prior to attaching the at least one second spring of pocketed springs to the innerspring main body.

8. The method of claim 1, wherein the method is performed as a fully automated process by an innerspring unit assembly machine.

9. The method of claim 8, wherein the innerspring unit assembly machine comprising a first station for providing the innerspring main body by carrying out step (a) and a second station for manufacturing the innerspring unit from the innerspring main body and the at least one second string of pocketed springs by carrying out step (b), wherein the innerspring main body is transported from the first station to the second station using a conveyor device.

10. A method for manufacturing an innerspring unit comprising pocketed springs, the method comprising the steps of (a) providing an innerspring main body comprising a plurality of first strings of pocketed springs; and (b) attaching at least one second string of pocketed springs to a lateral surface of the innerspring main body, so that the at least one second string of pocketed springs extends in a longitudinal direction of the innerspring main body, wherein the springs of the at least one second string of pocketed springs have a spring characteristic or a spring geometry different from the springs of the plurality of first strings of the innerspring main body, the at least one second string of pocketed springs forming together with the innerspring main body the innerspring unit, wherein step (b) comprises compressing the springs of the at least one second string of pocketed springs prior to attaching the at least one second spring of pocketed springs to the innerspring main body and allowing the compressed strings to expand after attaching the at least one second spring of pocketed springs to the lateral surface of the innerspring main body.

11. The method of claim 10, wherein the method is performed as a fully automated process by an innerspring unit assembly machine.

12. The method of claim 11, wherein the innerspring unit assembly machine comprising a first station for providing the innerspring main body by carrying out step (a) and a second station for manufacturing the innerspring unit from the innerspring main body and the at least one second string of pocketed springs by carrying out step (b), wherein the innerspring main body is transported from the first station to the second station using a conveyor device.

13. The method of claim 10, wherein step (a) comprises providing the innerspring main body with at least one third string of pocketed springs at a first longitudinal end of the innerspring main body and with at least one fourth string of pocketed springs at a second longitudinal end of the innerspring main body, wherein the springs of the at least one third string of pocketed springs and the springs of the at least one fourth string of pocketed springs have a spring characteristic or a spring geometry different from the springs of the plurality of first strings of the innerspring main body.

14. The method of claim 13, wherein step (b) comprises attaching at least one second string of pocketed springs to a first lateral side surface and to a second lateral side surface of the innerspring main body, so that the springs of the second, third and fourth strings of pocketed springs form an edge area completely surrounding the first strings of pocketed springs.

15. The method of claim 13, wherein the springs of the second, third and fourth strings of pocketed springs are configured such that a stability of the innerspring unit at an edge area thereof is increased compared to an area where the springs of the first strings of pocketed springs are arranged.

16. The method of claim 10, wherein step (b) comprises clamping the fleece sheets by a clamping device and pushing the at least one second string of pocketed springs with a pusher between the fleece sheets to the lateral side of the innerspring main body.

17. The method of claim 10, wherein step (b) comprises applying a glue to the pair of fleece sheets by a gluing device prior to attaching the at least one second spring of pocketed springs to the innerspring main body.

18. The method of claim 10, wherein step (b) comprises applying a glue to the lateral side of the innerspring main body by a gluing device prior to attaching the at least one second spring of pocketed springs to the innerspring main body.

19. A method for manufacturing an innerspring unit comprising pocketed springs, the method comprising the steps of (a) providing an innerspring main body comprising a plurality of first strings of pocketed springs; and (b) attaching at least one second string of pocketed springs to a lateral surface of the innerspring main body, so that the at least one second string of pocketed springs extends in a longitudinal direction of the innerspring main body, wherein the springs of the at least one second string of pocketed springs have a spring characteristic or a spring geometry different from the springs of the plurality of first strings of the innerspring main body, the at least one second string of pocketed springs forming together with the innerspring main body the innerspring unit, wherein step (a) comprises attaching a pair of fleece sheets to upper and lower surfaces of the innerspring main body, so that the fleece sheets cover the innerspring main body; and wherein step (b) comprises attaching the at least one second string of pocketed springs to the lateral surface of the innerspring main body such that it is arranged between the pair of fleece sheets.

20. The method of claim 19, wherein step (a) comprises providing the innerspring main body with at least one third string of pocketed springs at a first longitudinal end of the innerspring main body and with at least one fourth string of pocketed springs at a second longitudinal end of the innerspring main body, wherein the springs of the at least one third string of pocketed springs and the springs of the at least one fourth string of pocketed springs have a spring characteristic or a spring geometry different from the springs of the plurality of first strings of the innerspring main body.

* * * * *